US006609566B2

(12) United States Patent
Perio, Jr.

(10) Patent No.: US 6,609,566 B2
(45) Date of Patent: Aug. 26, 2003

(54) GRIPPER BLOCK ASSEMBLY FOR COILED TUBING INJECTOR HEAD

(75) Inventor: Dudley Joseph Perio, Jr., Austin, TX (US)

(73) Assignee: Drilling & Coiled Technology, Inc., a division of Gotco International, Inc., Tomball, TX (US)

( * ) Notice: Subject to any disclaimer, the term of this patent is extended or adjusted under 35 U.S.C. 154(b) by 0 days.

(21) Appl. No.: 10/006,560

(22) Filed: Nov. 5, 2001

(65) Prior Publication Data

US 2002/0046833 A1 Apr. 25, 2002

Related U.S. Application Data

(62) Division of application No. 09/232,443, filed on Jan. 15, 1999, now Pat. No. 6,347,664.

(51) Int. Cl.[7] ..... E21B 19/08; E21B 19/22

(52) U.S. Cl. ..... 166/77.3; 226/173

(58) Field of Search ..... 166/77.1, 77.2, 166/77.3; 37/302, 352, 353; 226/170, 171, 172, 173; 299/82.1, 83.1

(56) References Cited

U.S. PATENT DOCUMENTS

| | | | | |
|---|---|---|---|---|
| 2,637,917 A | | 5/1953 | Klaucke | 37/352 |
| 2,666,273 A | | 1/1954 | McIninch | 37/352 |
| 2,720,717 A | | 10/1955 | Arps | 299/83.1 |
| 3,056,535 A | | 10/1962 | Baugh et al. | 226/172 |
| 3,143,269 A | | 8/1964 | Van Eldik | 226/172 |
| 3,285,485 A | | 11/1966 | Slator | 226/172 |
| 4,196,561 A | | 4/1980 | Kruse | 53/300 |
| 4,585,061 A | | 4/1986 | Lyons, Jr. et al. | 166/77 |
| 4,655,291 A | | 4/1987 | Cox | 166/385 |
| 4,735,270 A | | 4/1988 | Fenyvesi | 166/77.1 |
| 5,133,405 A | | 7/1992 | Elliston | 166/77 |
| 5,188,174 A | | 2/1993 | Anderson Jr. et al. | 166/77 |
| 5,279,364 A | | 1/1994 | Jantzen et al. | 166/77.3 |
| 5,309,990 A | | 5/1994 | Lance | 166/77 |
| 5,553,668 A | | 9/1996 | Council et al. | 166/77.3 |
| 5,566,764 A | | 10/1996 | Elliston | 166/385 |
| 5,775,417 A | | 7/1998 | Council | 166/77.3 |
| 5,890,534 A | | 4/1999 | Burge et al. | 166/77.3 |
| 5,918,671 A | | 7/1999 | Bridges et al. | 166/77.3 |
| 5,930,923 A | | 8/1999 | Nishiguchi | 37/352 |
| 5,937,943 A | | 8/1999 | Butler | 166/77.2 |
| 5,975,203 A | | 11/1999 | Payne et al. | 166/77.3 |
| 5,975,207 A | | 11/1999 | Smitherman | 166/77.1 |
| 6,173,769 B1 | | 1/2001 | Goode | 166/77.3 |
| 6,189,609 B1 | * | 2/2001 | Shaaban et al. | 166/384 |
| 6,332,501 B1 | * | 12/2001 | Gipson | 166/384 |

FOREIGN PATENT DOCUMENTS

| | | | |
|---|---|---|---|
| CA | 953644 | 8/1974 | 166/77.3 |

* cited by examiner

*Primary Examiner*—Thomas B. Will
*Assistant Examiner*—Nathan Mammen
(74) *Attorney, Agent, or Firm*—Williams, Morgan & Amerson, P.C.

(57) ABSTRACT

A coiled tubing injector head comprised of a plurality of endless chains, each of which are at least three links wide, that are positioned around a plurality of sprockets and/or idler rollers within the injector head. A plurality of gripper assemblies are positioned around the middle links of the endless chains. A bearing skate is positioned within the injector head, the bearing skate be comprised of a plurality of bearings in a staggered configuration, the bearings being adapted for rolling engagement with a portion of the gripper assemblies. An injector head is comprised of a plurality of halves, each of the halves being coupled to a positioning bar, the positioning bar having a plurality of openings formed therein, the openings adapted for use in varying the distance between the first and second halves.

44 Claims, 11 Drawing Sheets

GRIPPER BLOCK ASSEMBLY FOR COILED TUBING INJECTOR HEAD

This is a divisional of application Ser. No. 09/232,443, filed Jan. 15, 1999, now U.S. Pat. No. 6,347,664.

BACKGROUND OF THE INVENTION

1. Field of the Invention

The present invention is generally directed to the field of oilfield production equipment, and, more particularly, to an injector head for inserting and withdrawing coiled tubing into and from a well.

2. Description of the Related Art

After wells are drilled into the earth, coiled tubing is often inserted into and withdrawn from a well for a variety of purposes. For example, coiled tubing may be inserted to produce hydrocarbons, i.e., oil and gas, to inject various fluids to stimulate the production of hydrocarbons, to clean various portions of the well, etc. As is well known by those skilled in the art, coiled tubing is a relatively small, continuous length of thin-walled tubing that has an outside diameter varying from approximately ½"–3½". It is envisioned that even larger sizes of coiled tubing may be used in the future.

Tubing is typically supplied on a large spool that contains many thousands of feet in a coiled arrangement. In practice, the spool of tubing is mounted on a large truck that is positioned adjacent the well. The coiled tubing may be continuously fed into or withdrawn from a well using what is generally known in the industry as a coiled tubing injector head. Injector heads vary in design and construction from manufacturer to manufacturer. However, most injector heads are comprised of a pair of opposed endless chain loops that carry a plurality of gripper blocks that are pressed against and grab generally opposed sides of the coiled tubing when it is inserted therebetween. Typically, the endless chains are mounted on an arrangement of drive sprockets and idler sprockets or rollers, and the chains are driven by one or more hydraulic or electric motors. In this manner, the gripper blocks positioned on the endless chains act to grab and push (insertion operation) or pull (withdrawal operation) the coiled tubing as the endless chain moves. Illustrative examples of some of the various types of injector heads known in the industry are set forth in U.S. Pat. Nos. 4,585,061, 4,655,291, 5,133,405, 5,188,174, 5,309,990, 5,553,668, and 5,566,764, all of which are hereby incorporated by reference in their entirety. However, there are many problems associated with currently known injector heads.

The endless chains used in modem injector heads are sometimes comprised of a plurality of one-piece gripper blocks that are positioned between two rollers of a triple-wide chain through the use of one or more pins. See, e.g., FIG. 9 of U.S. Pat. No. 4,585,061 and FIGS. 5 and 6 of U.S. Pat. No. 5,188,174. During the course of manufacturing the injector head, this design necessitates that the manufacturer of an injector head take a standard triple-wide chain, or at least components of it, and assemble what is a special chain assembly. As can be appreciated by those skilled in the art, this can be a very time-consuming and expensive process. For example, a manufacturer might purchase a traditional triple-wide roller chain, remove the middle roller section, and install a plurality of one-piece gripper blocks on multiple master links that are used to secure the chain together. These master links are positioned within openings formed in the gripper block. See, e.g., FIG. 9 of U.S. Pat. No. 4,585,061. Alternatively, the gripper blocks may be secured to the chain by multiple pins that do not extend completely through the gripper blocks. See, e.g., FIGS. 5 and 6 of U.S. Pat. No. 5,188,174. In such configurations, the gripper blocks, typically comprised of an investment cast steel, engage the master links and/or pins. This type of engagement is subject to excessive wearing. Moreover, the chains, when disassembled and/or reassembled in this manner, no longer comply with various standard setting bodies, such as ISO9000 or API.

With either technique, as well as others not specifically described above, prior art devices often required the injector head manufacturer to spend many hours assembling and disassembling the endless chains used in the injector heads. These type of designs also caused problems beyond those encountered during the initial assembly of the injector head. For example, replacement of a gripper block on one of the aforementioned injector heads requires manipulation and at least partial removal of some of the pins securing the gripper block to the chain. In some cases, removal of one or more gripper blocks required disassembly of the chain entirely. Moreover, if it was deemed necessary to replace the gripper blocks to accommodate different diameter coiled tubing, the process involved could be very time-consuming and require complete disassembly and reassembly of the chain.

Additionally, other types of injector heads employ gripper blocks with removable inserts that are coupled to the gripper block body by a plurality of fasteners, e.g, socket head bolts or socket head screws. In these type of systems the fasteners became loose during operation, causing maintenance problems and downtime. These type of systems typically required repeated tightening of the fasteners, which caused delay and subjected the fasteners to higher stresses.

Another problem encountered with existing injector head designs relates to bearing skates employed in such devices. Injector heads typically involve the use of one or more bearing skates that are used to transmit a gripper force to the gripper blocks positioned in the endless chain. The bearing skates are typically coupled to one or more hydraulic cylinders that, when actuated, tend to force the gripper blocks together, thereby asserting a gripping force on the coiled tubing positioned between the gripper blocks. See, e.g., the skate and hydraulic cylinder arrangement described at, for example, column 6, line 37, to column 7, line 38, of U.S. Pat. No. 5,188,174. The bearing skates used in modem injector heads also contain a number of bearings that are adapted to rollingly engage a portion of the gripper blocks to transmit the force supplied by the hydraulic cylinders to the gripper blocks. With prior art injector heads, the bearings used on bearing skates were arranged in an in-line, non-staggered arrangement. See, e.g., FIG. 4 of U.S. Pat. No. 5,188,174. Such an in-line bearing arrangements lead to numerous problems. For example, using prior art in-line bearing arrangements, fewer bearings were in contact with a given gripper assembly, i.e., the number of bearings that were able to contact and support any particular gripper block was limited. With fewer bearings available to contact the gripper block, bearing loading increased and, as might be expected, bearing life decreased. These factors tend to lead to reduced operating time, reduced life and increased maintenance for a given injector head employing a bearing skate having a traditional in-line bearing arrangement.

Another problem encountered with existing injector heads is the overall weight of such devices. As stated previously, coiled tubing comes in many sizes. Currently, coiled tubing is used in sizes ranging from approximately ½" to 3½" in diameter. It is anticipated that even larger coiled tubing will be used in the future. However, current injector heads are designed on a worst case basis. That is, currently available injector heads are designed such that all components, e.g., frame, gears, motors, etc., are capable of withstanding all anticipated forces that will be encountered during the injection and withdrawal of at least the largest diameter coiled tubing. In turn, this process leads to an injector head that is excessively heavy. While this design strategy adds cost to the initial manufacture of the injector head, which is undesirable in and of itself, the increase in the weight of the injector head is very undesirable.

As those skilled in the art understand and appreciate, an injector head is typically transported to the site of the well by truck. Typically, the weight of these injector heads may vary between approximately 7,000–14,000 pounds. The Federal Department of Transportation (DOT) has very strict limitations on the shipping weight of articles, including injector heads, that are transported on our nation's highways and bridges. Thus, it is desirable to have an injector head that, while still capable of being used with a full range of existing sizes of coiled tubing, weighs less than prior art injector heads.

With existing coiled tubing injector heads, in normal operation, the distances between various components remains relatively fixed regardless of the size of tubing used. For example, current injector heads are designed to accommodate at least the largest anticipated coiled tubing size, i.e., the injector heads are designed for a worst case design. As stated previously, coiled tubing may vary in diameter from approximately ½" to 3½", and even larger sizes are anticipated to be used in the future. However, most of the coiled tubing applications involve coiled tubing having a diameter less than 3". For example, it is believed that less than five percent of the coiled tubing applications involve coiled tubing having a diameter of 3" or greater.

On existing injector heads that are designed to accommodate both the smaller and larger sizes of coiled tubing, the distance between the centerline of the tubing and the centerlines of the respective endless chains remains fixed at a distance that will accommodate the larger diameter coiled tubing. To use these type of injector heads with smaller diameter coiled tubing, the size of the gripper block must be effectively increased. This may be accomplished by installing larger gripper blocks and/or by installing inserts on existing gripper blocks. These modifications are made so as to allow the gripper blocks to reach the smaller diameter tubing. These larger gripper blocks and/or inserts increase the weight of an already heavy injector head. Moreover, the effort to change out these gripper blocks and/or inserts can be quite time-consuming and expensive.

The present invention is directed to an apparatus for solving, or at least reducing the effects of, some or all of the aforementioned problems.

SUMMARY OF THE INVENTION

The present invention is directed to an injector head having a plurality of endless chains, the endless chains having a plurality of links. The invention further comprises a plurality of gripper block assemblies positioned around the links of the endless chains.

In another aspect of the present invention, an injector head is comprised of a plurality of ISO9000 or API certified endless chains, said chains having a plurality of links and a plurality of multiple-piece gripper block assemblies.

BRIEF DESCRIPTION OF THE DRAWINGS

The invention may be understood by reference to the following description taken in conjunction with the accompanying drawings, in which like reference numerals identify like elements, and in which.

Figure 1A:
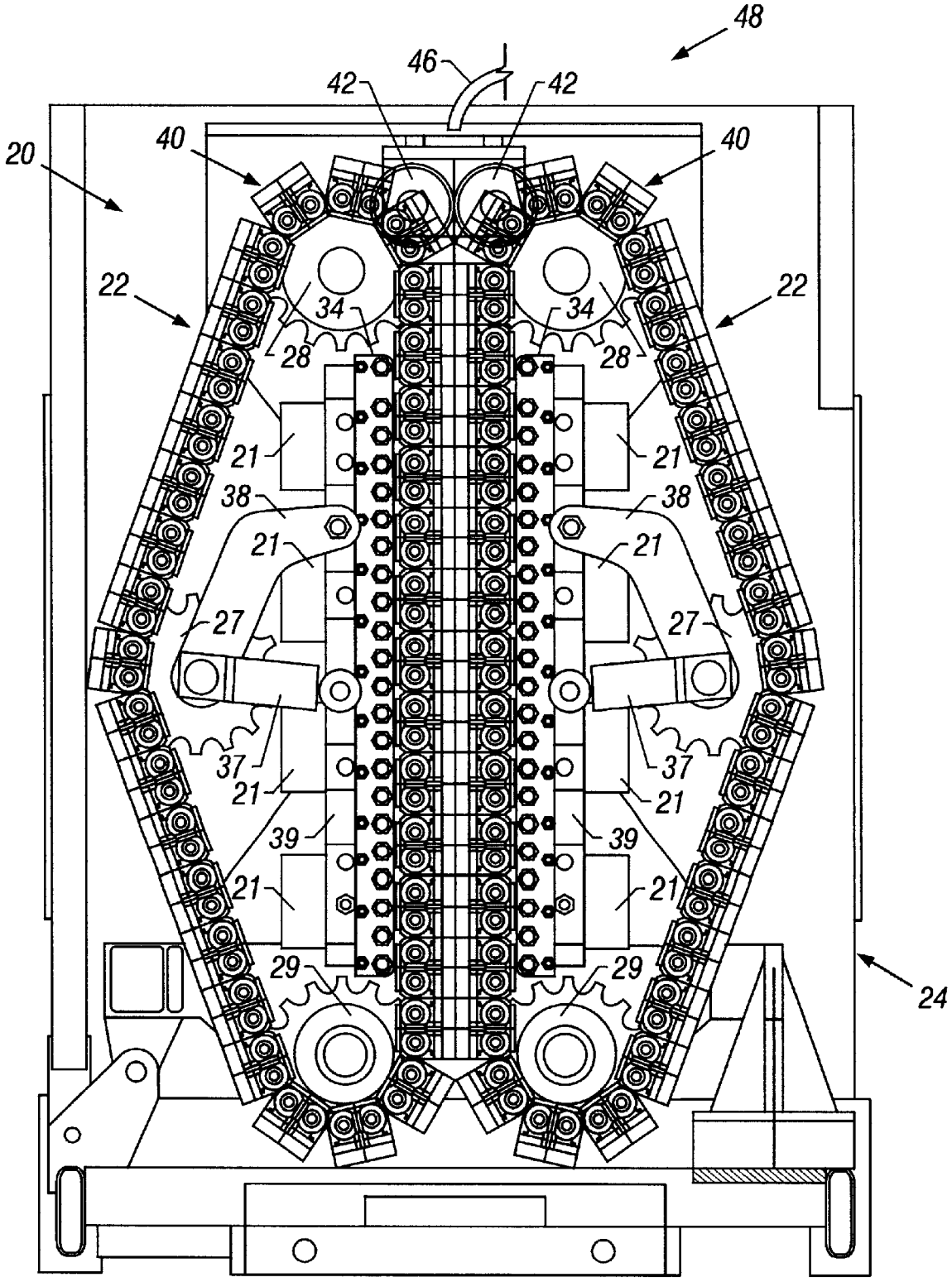
FIG. 1A is a partial, cross-sectional side view of an illustrative coiled tubing injector head comprising one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1B:
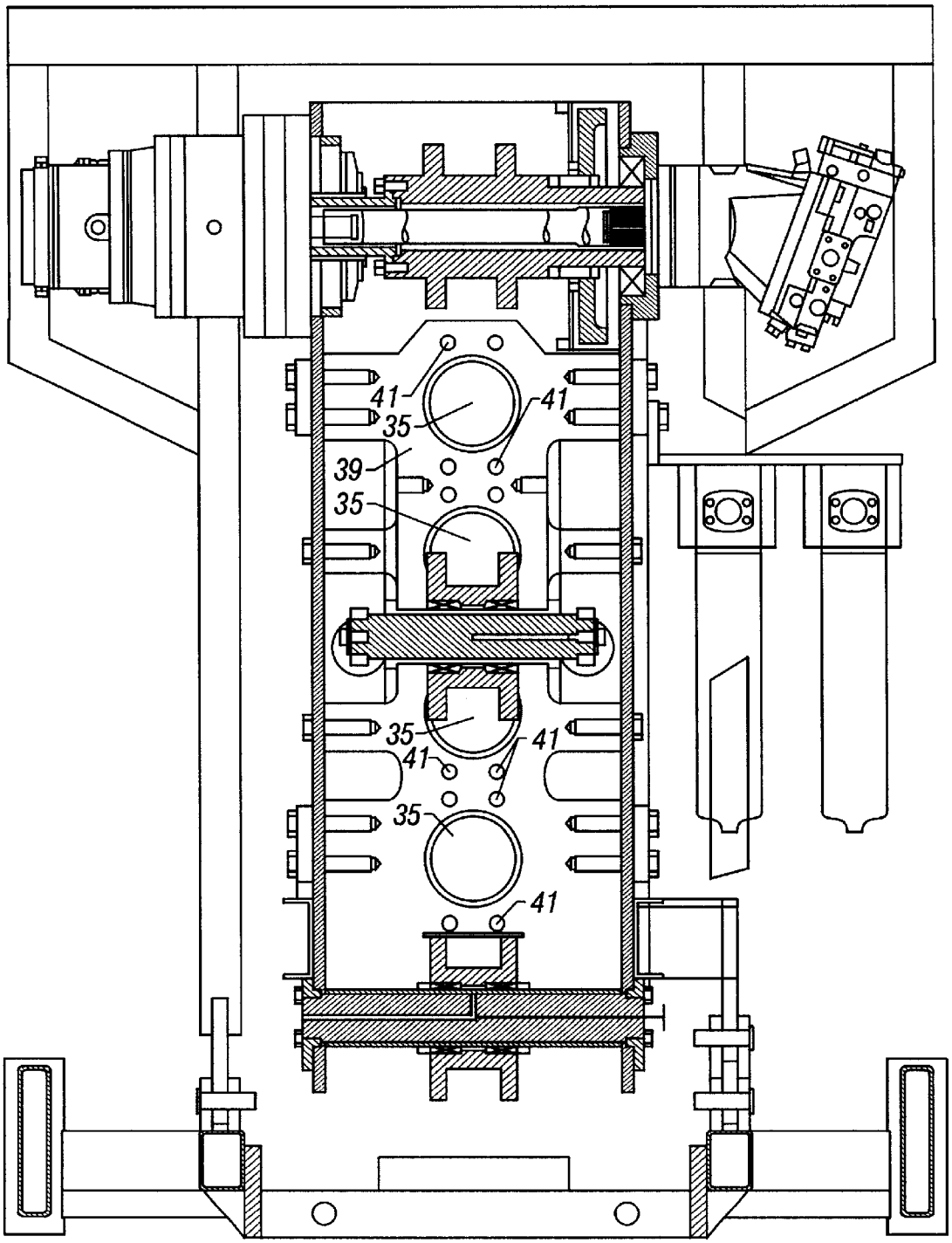
FIG. 1B is a partial, cross-sectional rear view of an illustrative coiled tubing injector head comprising one illustrative embodiment of the present invention.

As shown in FIGS. 1A and 1B, an injector head 20 is comprised of a frame 24, a plurality of endless chains 22, and a plurality of gripper block assemblies 40 coupled to the endless chains 22. The injector head 20 is further comprised of a plurality of drive sprockets 28, a plurality of idler sprockets 27, 29, a plurality of bearing skates 34, a plurality of dual-action hydraulic tensioning cylinders 37, and a plurality of lever arms 38. The injector head 20 is further comprised of a plurality of timing gears 42, a plurality of dual-action hydraulic traction cylinders 21, and a plurality of spline plates 39.

As is known to those skilled in the art, the endless chains 22 tend to lengthen or stretch over a period of time during normal operations. One illustrative technique for correcting for this stretching is shown in FIG. 1A wherein the tensioning cylinder 37, positioned between the idler sprocket 27 and one of the spline plates 39, is used to insure that the endless chains 22 remain sufficiently tight for operating purposes. As will be apparent to one skilled in the art, increasing the distance between the idler sprocket 27 and the spline plate 39 by extending the tensioning cylinder 37 increases the tension of the endless chains 22.

The bearing skate 34 is slidingly coupled to the spline plate 39 of the injector head 20 through a plurality of rods 137 (see FIGS. 6B and 6C) that are adapted to be slidingly positioned within a plurality of openings 41 (see FIG. 1B) formed in the spline plate 39. The sliding engagement between the rods 137 and the openings 41 allows the bearing skates 34 to move toward and away from one another in response to forces generated by the traction cylinders 21, when actuated. The rods 137 and the openings 41 also act to maintain alignment of the bearing skates 34 as they are moved.

During operation, coiled tubing 46 is inserted through a top portion 48 of the injector head 20, through a plurality of rollers (not shown) and into engagement with the plurality of gripper block assemblies 40 as the endless chains 22 are rotated (one clockwise and the other counter-clockwise) by a plurality of hydraulic motors (not shown) drivingly coupled to the drive sprockets 28. The gripping force on the coiled tubing 46 may be controlled by the amount of force applied by the traction cylinders 21. The particular types of sprockets, hydraulic cylinders, motors, chains, and other components used in the injector head 20 are all matters of design choice, the selection and sizing of which may vary depending upon a particular application. All of these features are matters within the level of those of ordinary skill in the art, and as such should not be considered a limitation of the present invention.

Figure 2A:
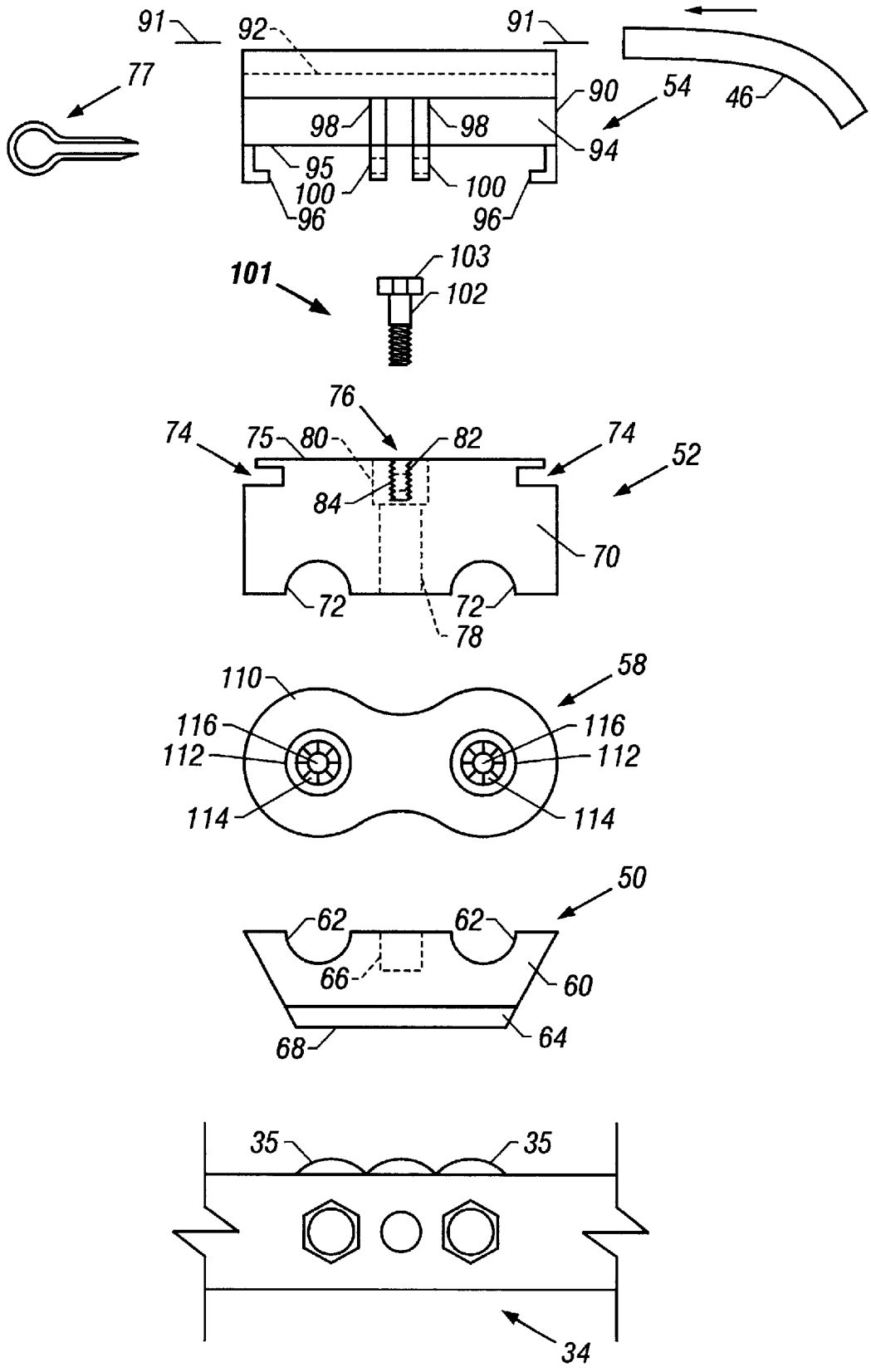
FIG. 2A is an exploded, partially cross-sectional view of one illustrative embodiment of the present invention.
Figure 2B:
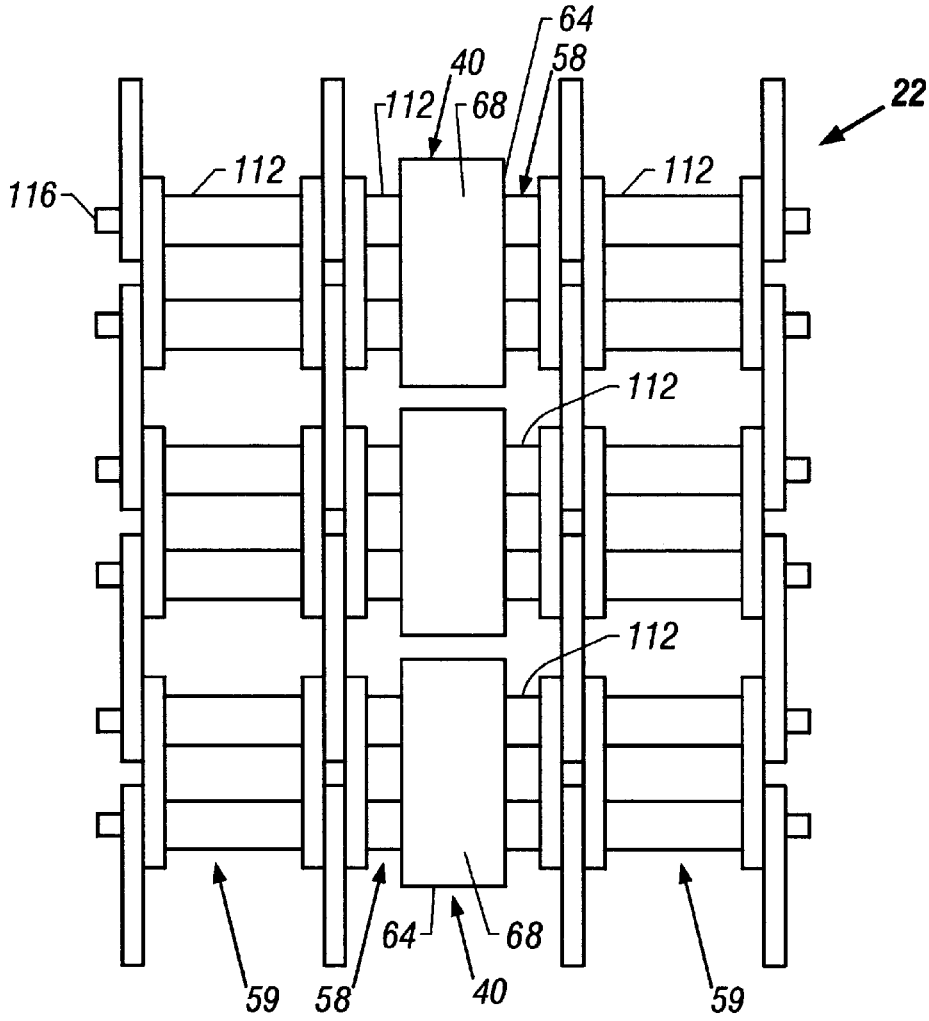
FIG. 2B is a plan view of a portion of an endless chain having a plurality of gripper block assemblies positioned thereon.

One illustrative embodiment of the gripper block assembly 40 is depicted in FIGS. 2A and 2B. As shown therein, the gripper block assembly 40 is comprised of a chain skate 50, a gripper block holder 52, and a gripper block 54. Additional views of the chain skate 50, the gripper block holder 52, and the gripper block 54 are shown in FIGS. 3A–3C, 4A–4C and 5A–5C, respectively.

As shown in FIGS. 2A and 2B, a plurality of gripper block assemblies 40 are adapted to be positioned around a plurality of corresponding middle links 58 of an illustrative triple-wide endless chain 22. The illustrative endless chain 22 depicted in FIG. 2B is comprised of a plurality of middle links 58 and a plurality of side links 59. The side links 59 and middle links 58 are typically secured together by a plurality of pins 16. Each of the middle links 58 and the side links 59 are also typically comprised of a plurality of rollers 112. The endless chain 22 may be any of the type commonly employed in traditional injector heads. For example, the endless chain 22 could be an ASA160-3 API and/or ISO9000 approved type chain. Although most modem injector heads employ endless chains that are three links wide, the present invention may be used with endless chains that are wider (i.e., more links) or narrower (i.e., fewer links). However, the particular details of construction for the endless chain 22, the middle links 58, and the side links 59 should not be considered a limitation of the present invention.

Figure 6A:
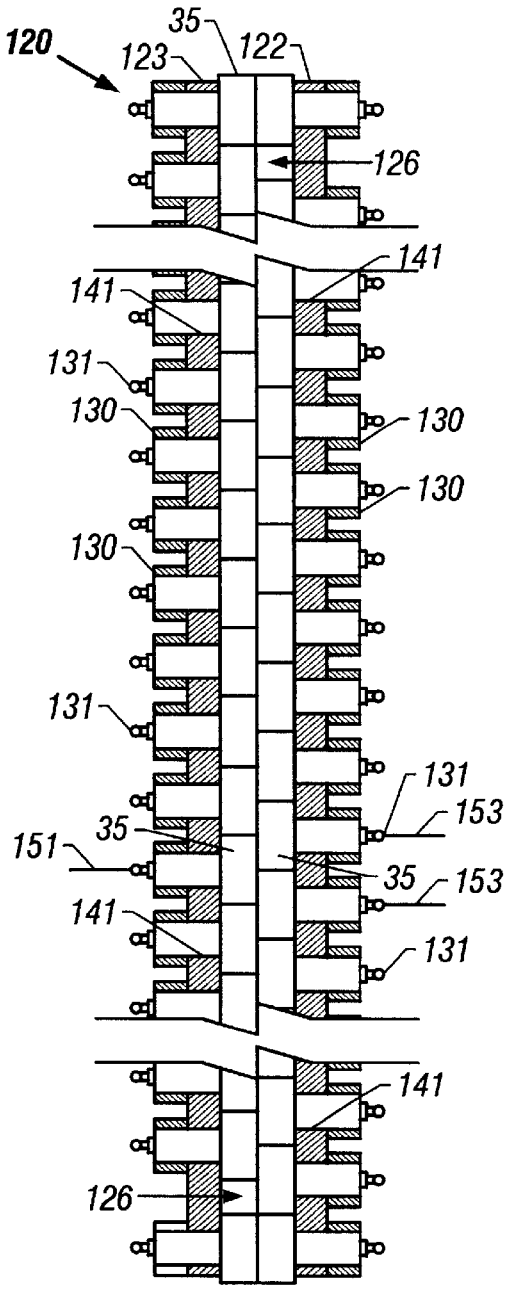
FIGS. 6A–6C are additional views of an illustrative bearing skate of the present invention.
Figure 6B:
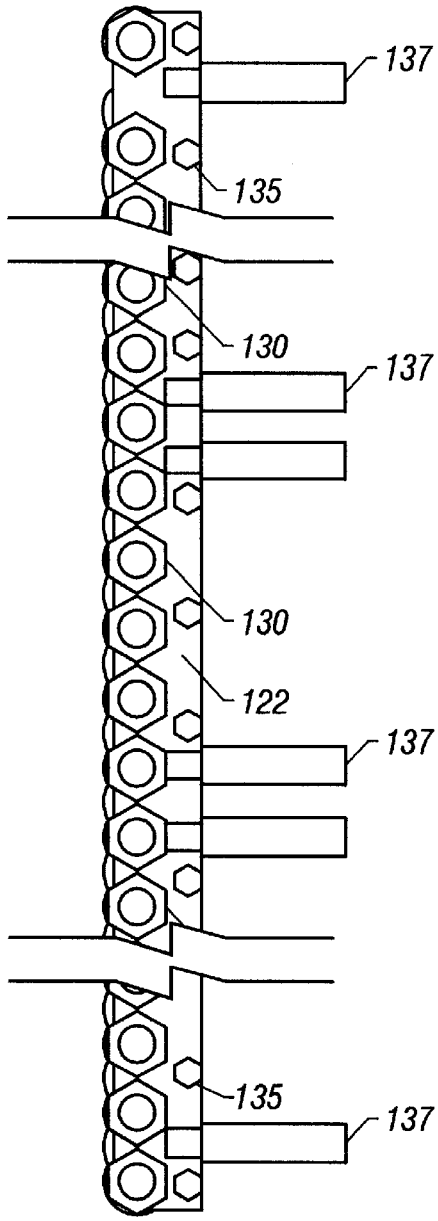
Figure 6C:
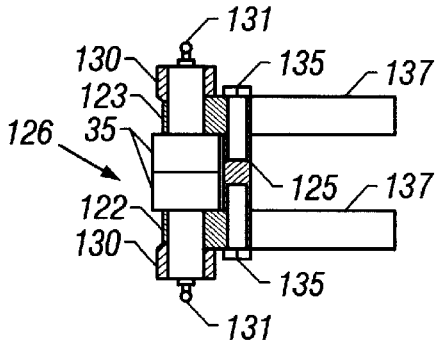

As shown in FIG. 2A, in the particular embodiment of the gripper block assembly 40 disclosed herein, the chain skate 50 and gripper block holder 52 are adapted to be positioned around an illustrative middle link 58 of the endless chain 22. The chain skate 50 is comprised of a body 60, a plurality of recesses 62, a flange 64 and a threaded recess 66. The chain skate 50 has a surface 68 that is adapted to engage a plurality of bearings 35 coupled to the bearing skate 34. In one illustrative embodiment, the surface 68 is approximately $2\frac{15}{16}$ inches wide and $3\frac{1}{8}$ inches long that results in a surface area of approximately $9\frac{1}{8}$ square inches. Additional views of the bearing skate 34 are shown in FIGS. 6A–6C, and it is described more fully below.

The gripper block holder 52 is comprised of a body 70, a plurality of recesses 72, a plurality of slots 74, and a dual-bore, through-hole 76 having a first diameter 78 and a second diameter 80, the second diameter 80 being larger than the first diameter 78. The gripper block holder 52 further comprises a bracket 82 having an opening 84 formed therein.

The gripper block 54 is comprised of a body 90, an elongated, arcuate recess 92, an inclined surface 94, a plurality of projections 96, and a plurality of brackets 98, each bracket 98 having an opening 100 formed therein. The arcuate recess 92 is adapted to engage the illustrative coiled tubing 46 shown in FIG. 2A. Additionally, a liner (not shown) may be positioned in the recess 92 for engagement with the coiled tubing 46. Such liners are known in the art and will not be explained in further detail herein. The recess 92 has a long axis 91 that is approximately parallel, if not co-linear, with a long axis of the coiled tubing 46 when the gripper block 54 is engaged with the coiled tubing 46.

The illustrative middle link 58 is shown in cross-section and is comprised of a roller link plate 110, a plurality of rollers 112, a plurality of bushings 114 (shown cross-hatched in FIG. 2A), and a plurality of pins 116. The precise details of construction of the illustrative middle link 58 are provided by way of example and explanation only, and these details should not be considered a limitation of the present invention.

The assembly of the illustrative example of the gripper block assembly 40 disclosed herein will now be described. As stated previously, the chain skate 50 and the gripper block holder 52 are adapted to be positioned around the rollers 112 of the illustrative middle link 58. That is, the recesses 62 and 72 are adapted to be positioned around the rollers 112 of the middle link 58. In the illustrative embodiment shown in FIGS. 2A and 2B, the recesses 62 and 72 are adapted to engage the rollers 112, although it is envisioned that this may not be required or desirable in all cases. For example, an additional sleeve (not shown) could be positioned around each of the rollers 112, although this would likely require additional effort in chain manufacture or disassembly/reassembly. Alternatively, a liner (not shown) could be formed or positioned in the recesses 62, 72 if desired. Regardless of the particular interfacing structure, it is sufficient that the chain skate 50 and the gripper block holder 52 be positioned around the rollers 112 of the middle link 58.

In the illustrative embodiment of the gripper block assembly 40 depicted in FIG. 2A, the chain skate 50 and the gripper block holder 52 are releasably secured in position by a fastener 101. In one illustrative embodiment, the fastener 101 is a bolt 102 that is positioned through the dual-bore through-hole 76 and into threaded engagement with the threaded opening 66 in the chain skate 50. The size, shape and length of the threaded opening 66, the first diameter 78, the second diameter 80, and the bolt 102 are matters of design choice well within the ability of those skilled in the art. However, in the illustrative embodiment shown in FIG. 2A, the length of the bolt 102 and the depth of the threaded opening 66 are sized such that, when installed, a top surface 103 of the bolt 102 is beneath the surface 75 of the gripper block holder 52 when the chain skate 50 and the gripper block holder 52 are in their installed position around the middle link 58. That is, when installed, the top surface 103 of the bolt 102 does not extend above the surface 75 of the gripper block holder 52. Although the chain skate 50 and gripper block holder 52 are depicted in FIG. 2A is being removably coupled around the middle link 58, one skilled in the art will recognize that the chain skate 50 and the gripper block holder 52 could be positioned around the middle link 58 and then secured together by more or less permanent means, such as welding.

Figure 2C:
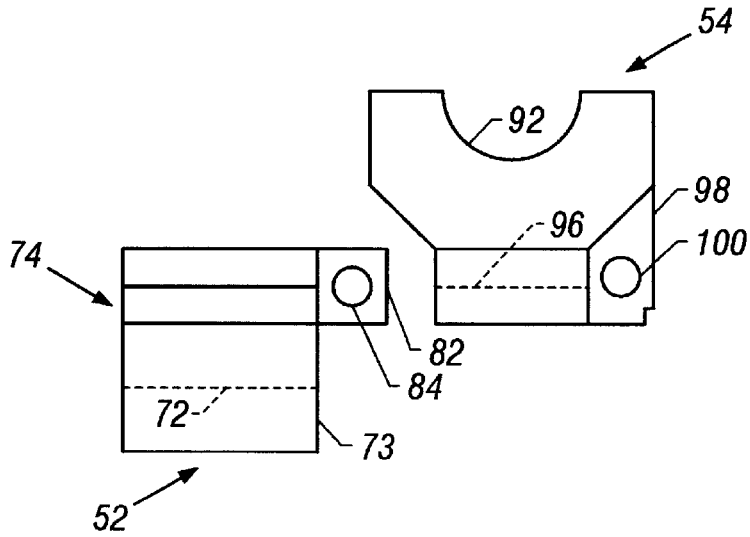
FIG. 2C is an elevational view of a portion of the illustrative gripper block assembly disclosed herein.
Figure 3A:
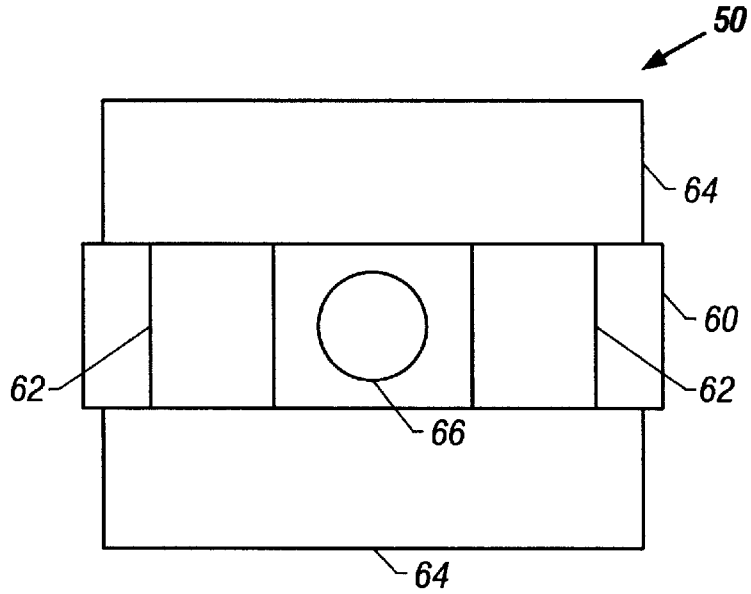
FIGS. 3A–3C are additional views of an illustrative bearing skate of the present invention.
Figure 3B:
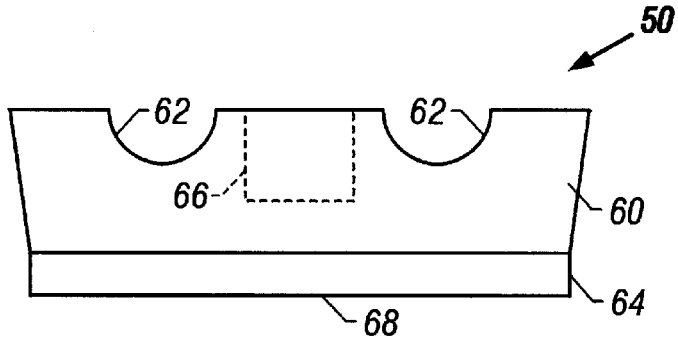
Figure 3C:
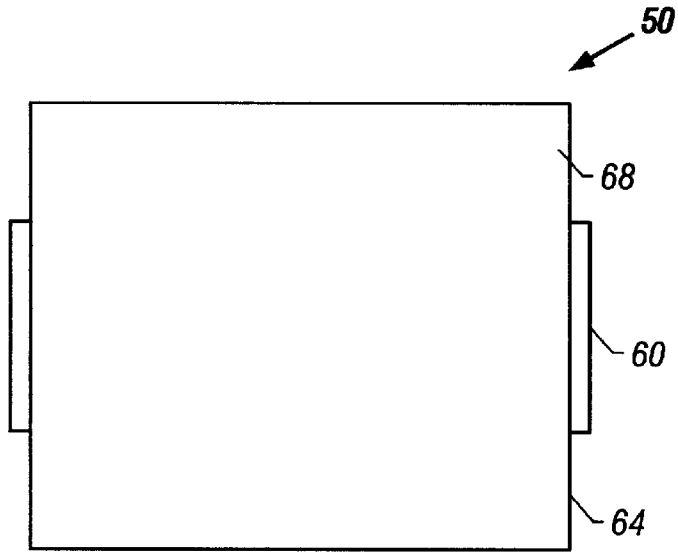
Figure 4A:
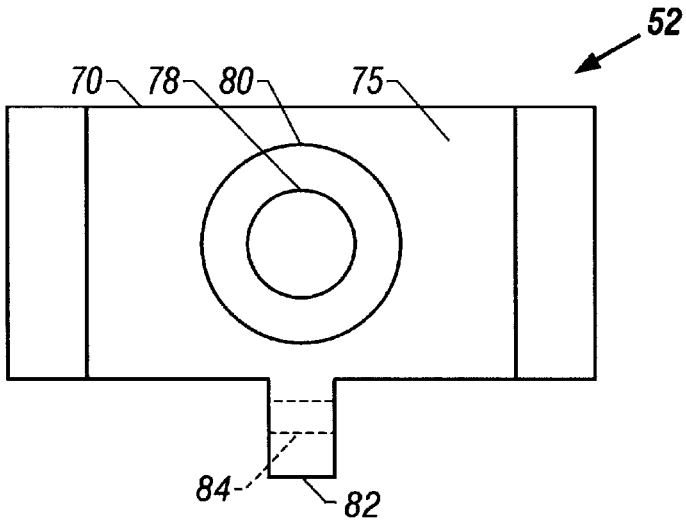
FIGS. 4A–4C are additional views of an illustrative gripper block holder of the present invention.
Figure 4B:
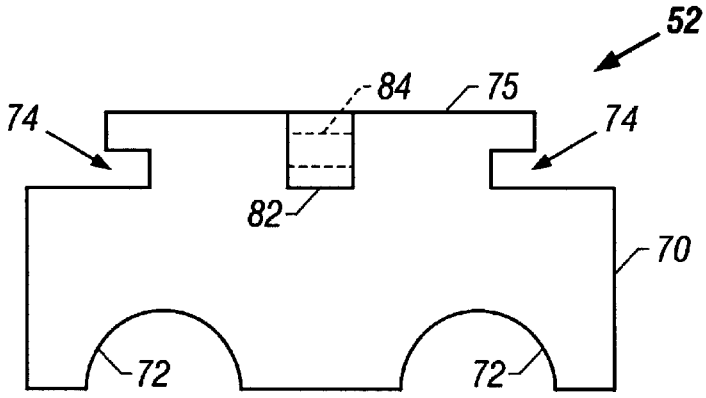
Figure 4C:
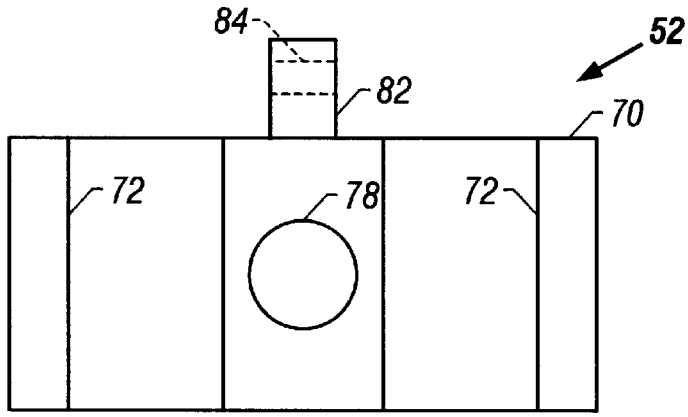
Figure 5A:
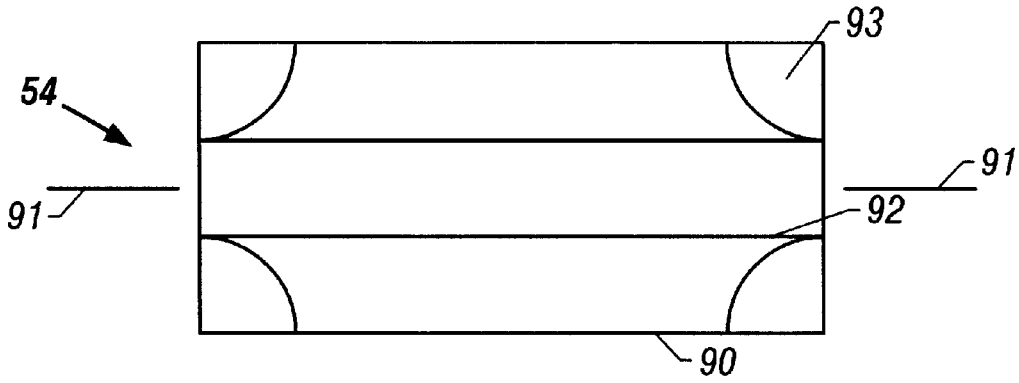
FIGS. 5A–5C are additional views of an illustrative gripper block of the present invention.
Figure 5B:
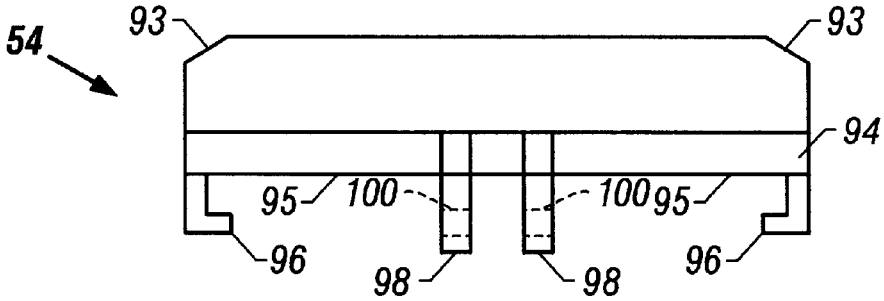
Figure 5C:
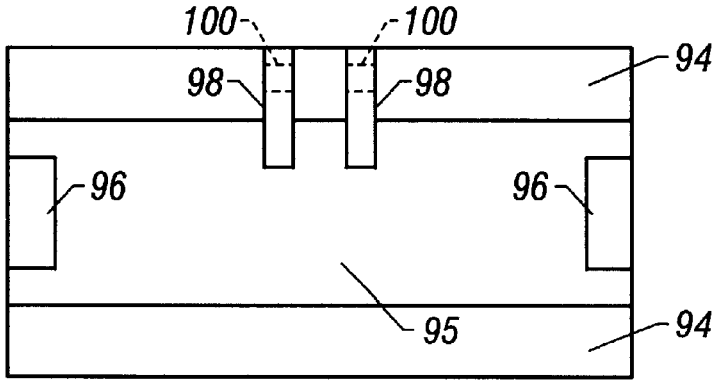

After the chain skate 50 and the gripper block holder 52 are positioned around the middle link 58, the gripper block 54 is coupled to the gripper block holder 52. In one illustrative embodiment of the gripper block 54 and the gripper block holder 52 depicted in FIG. 2A, this is accomplished by sliding engagement of the projections 96 on the gripper block 54 with the grooves 74 on the gripper block holder 52. As shown in FIG. 2C, this would be accomplished by first aligning the projections 96 with the slots 74 and sliding the gripper block 54 in the direction indicated by arrows 91 until such time as the projections 96 of the gripper block 54 engage a surface 73 of the gripper block holder 52. At that time, the opening 84 in the bracket 82 on the gripper block holder 52 should be aligned with the openings 100 in the brackets 98 on the gripper block 54. Thereafter, a cotter pin 77 (see FIG. 2A) or other similar device may be inserted through the aligned openings 84 and 100 to secure the engagement between the gripper block 54 and the gripper block holder 52.

In the particular embodiment shown in FIG. 2A, the surface 95 of the gripper block 54 is close enough to the surface 75 of the gripper block holder 52 such that it positively prevents the bolt 102 from inadvertently disengaging from the threaded opening 66 in the chain skate 50. Of course, alternative means could be devised for accomplishing the same result using a different structure. For example, rather than have the surface 95 prevent the movement of the bolt 102, a set screw or similar device could be inserted through a threaded opening (not shown) formed in the body 70 of the gripper block holder 52, such that the set screw extends into the second diameter 80 of the dual-bore through-hole 76 adjacent the top surface 103 of the bolt 102 after it has been installed. Additionally, the particular design of the dual-bore through-hole 76 can be modified without departing from the spirit of the invention. For example, the dual-bore through-hole 76 could also encompass the situation where a countersink hole is formed in the gripper block holder 52. Other types of fasteners 101 may also be used with the present invention.

Of course, modifications to the particular details of construction of the illustrative gripper block 54 and gripper block holder 52 may be made without departing from the spirit of the present invention. For example, the slots 74 may be formed on the gripper block 54 and the projections 96 may be formed on the gripper block holder 52. As another example, the gripper block 54 may only include one bracket 98 instead of two. Other modifications to the details of construction of the various components disclosed herein will be apparent to those skilled in the art. However, such details should not be considered a limitation of the present invention. Furthermore, the gripper block assembly 40 may be made of fewer pieces than the disclosed gripper block 54, gripper block holder 52, and chain skate 50. For example, a single structure may be substituted for the gripper block 54 and the gripper block holder 52, and that single structure could then be positioned around the middle link 58 and bolted to the chain skate 50 positioned on the other side of the middle link 58.

The materials of construction of the chain skate 50, the gripper block holder 52 and the gripper block 54 are all matters of design choice. For example, these components may be comprised of cast or forged iron or steel. Additionally, many of the various features may be formed directly in the casting or forging operations, or they may be formed by machining operations. In one illustrative embodiment, the gripper block 54, the gripper block holder 52, and the chain skate 50 are comprised of cast carbon steel.

As will be recognized by one skilled in the art upon a complete reading of the present application, the gripper block assembly 40 disclosed herein may be directly coupled to a triple-wide endless chain without the necessity of disassembling the endless chain 22. This allows an injector head to use an ISO9000 or API certified endless chain, i.e., standard chains may be used on injector heads using the present invention. The present invention also allows rapid replacement of damaged or worn gripper blocks 54, gripper block holders 52, or chain skates 50. In fact, all of the components of the gripper assemblies 40 can be removed and replaced without disassembly of the injector head 20. This may be accomplished by removing the cotter pin 77 and slidingly disengaging the gripper block 54 from the gripper block holder 52. This exposes the bolt 102 which may then be removed, thereby disassembling the gripper block holder 52 and the chain skate 50.

More detailed drawings of the illustrative bearing skate 34 of the present invention are shown in FIGS. 6A–6C. As shown therein, the bearing skate 34 is comprised of a body 120 having a plurality of side plates 122, 123 and a bottom plate 125. In the specifically disclosed embodiment, the side plates 122, 123 are bolted to the bottom plate 125 by a plurality of bolts 135. When assembled, the side plates 122, 123 and the bottom plate 125 define a recess 126 (see FIG. 6A) in which the bearings 35 will be positioned. The bearing skate 34 is further comprised of a plurality of bearings 35 positioned with the recess 126 and coupled to each of the side plates 122, 123. The bearings 35 are inserted through a plurality of holes 141 formed in the side plates 122, 123 and secured therein by a plurality of nuts 130. Note that each of the bearings 35 has a grease fitting 131 for supplying lubricant to the bearings 35. Of course, in lieu of the side plates 122, 123 and the bottom plate 125, the body 120 of the bearing skate 34 could be formed from a single piece of material, e.g., a single casting. In that case, the holes 141 could be replaced with a plurality of slots (not shown).

Additionally, as shown in FIGS. 6B and 6C, a plurality of rods 137 are coupled to the bearing skate 34. The rods 137 are adapted to be slidingly positioned in the openings 41 (see FIG. 1B) in the spline plate 39. The rods 137 act as guides to assist in maintaining the alignment of the bearing skate 34 when the traction cylinders 21 are actuated.

Additionally, although the bearing skate 34 specifically disclosed herein is comprised of a single length, those skilled in the art will appreciate that the bearing skate 34 could be comprised of multiple individual lengths or sections that are positioned adjacent the endless chains 22. Each of these individual lengths or sections of the bearing skate 34 may be coupled to its own separate traction cylinder 21, and may be individually actuated by such cylinder.

Moreover, as will be recognized by those skilled in the art, the bearing skate 34 of the present invention may be used on injector heads employing traditional single-piece gripper blocks commonly used in current injector heads. For example, the bearing skate 34 of the present invention may be used with gripper blocks of the type shown in FIG. 9 of U.S. Pat. No. 4,585,061. That is, the bearing skate 34 of the present invention is not limited to use with the particular gripper block assembly 40 disclosed herein.

Note that, centerlines 151 of the bearings 35 coupled to the side plate 122 are positionally staggered with respect to the centerlines 153 of the bearings 35 coupled to the side plate 123. This is in contrast to the prior art devices in which the bearings in analogous type structures were aligned with respect to one another. In particular, in the bearing skate 34 of the present invention, the bearings 35 are staggered by an amount that is approximately equal to one-half of the centerline spacing between adjacent bearings, plus, of course, some minimal distance to allow for mechanical clearance and production tolerances. Of course, if desired, the bearings 35 could be staggered apart a further or lesser distance.

The type, size, relative spacing and materials of construction for the bearings 35 and the bearing skate 34 are all matters of design choice that may vary depending upon any particular application. In one illustrative embodiment, for use in injecting coiled tubing up to a diameter of 5", the bearings 35 are 1¾" in diameter, and adjacent bearings 35 are spaced apart by a distance of approximately 1 13/16". The bearing skate 34 may be comprised of a variety of materials, such as cast or forged iron or steel. The physical dimensions of the bearing skate 34 depend, at least in part, upon the mechanical loading to be experienced by the bearing skate 34 during use. In one illustrative embodiment, the side plates 122, 123 are approximately ⅞" thick, and the recess 126 is approximately 1 11/16" deep and 2 1/16" wide. The thickness of the bottom plate 125 is approximately ¾". Of course, other physical dimensions and configurations of the bearing skate 34 are possible.

Through use of the staggered bearing arrangement described herein, additional bearings 35 may be brought into contact with the surface 68 of the chain skate 50. That is, by using the staggered bearing arrangement disclosed herein, at any given time, a minimum of three bearings 35 are in contact with the surface 68 of the flange 64 of the chain skate 50 substantially all of the time. By increasing the number of bearings 35 in contact with the surface 68 of the chain skate 50, bearing loading is reduced, which results in increased bearing life, reduced maintenance, and quieter operation, etc.

Figure 7A:
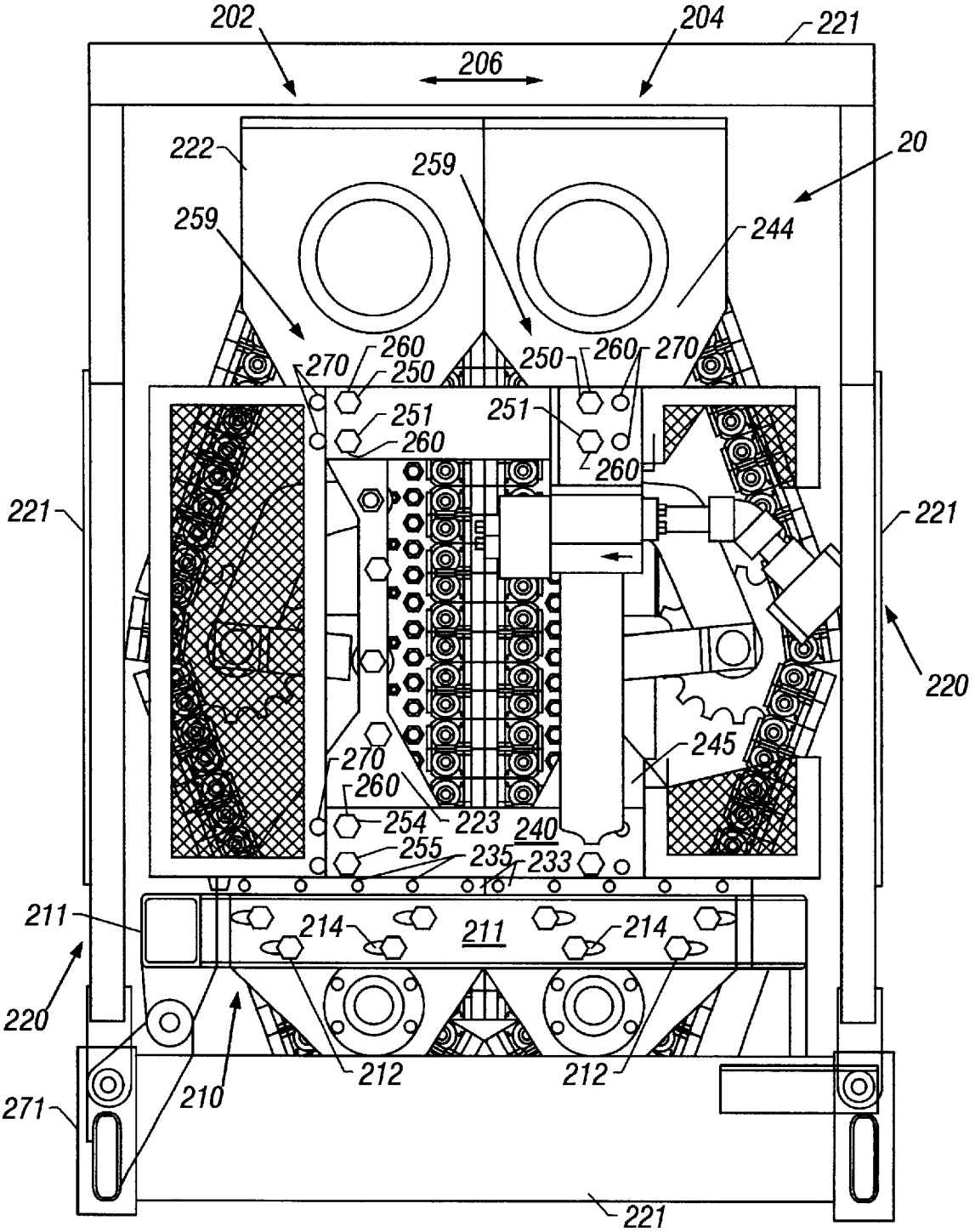
FIG. 7A is an illustrative, partial cross-sectional view of an injector head with an adjustable housing according to the present invention.
Figure 7B:
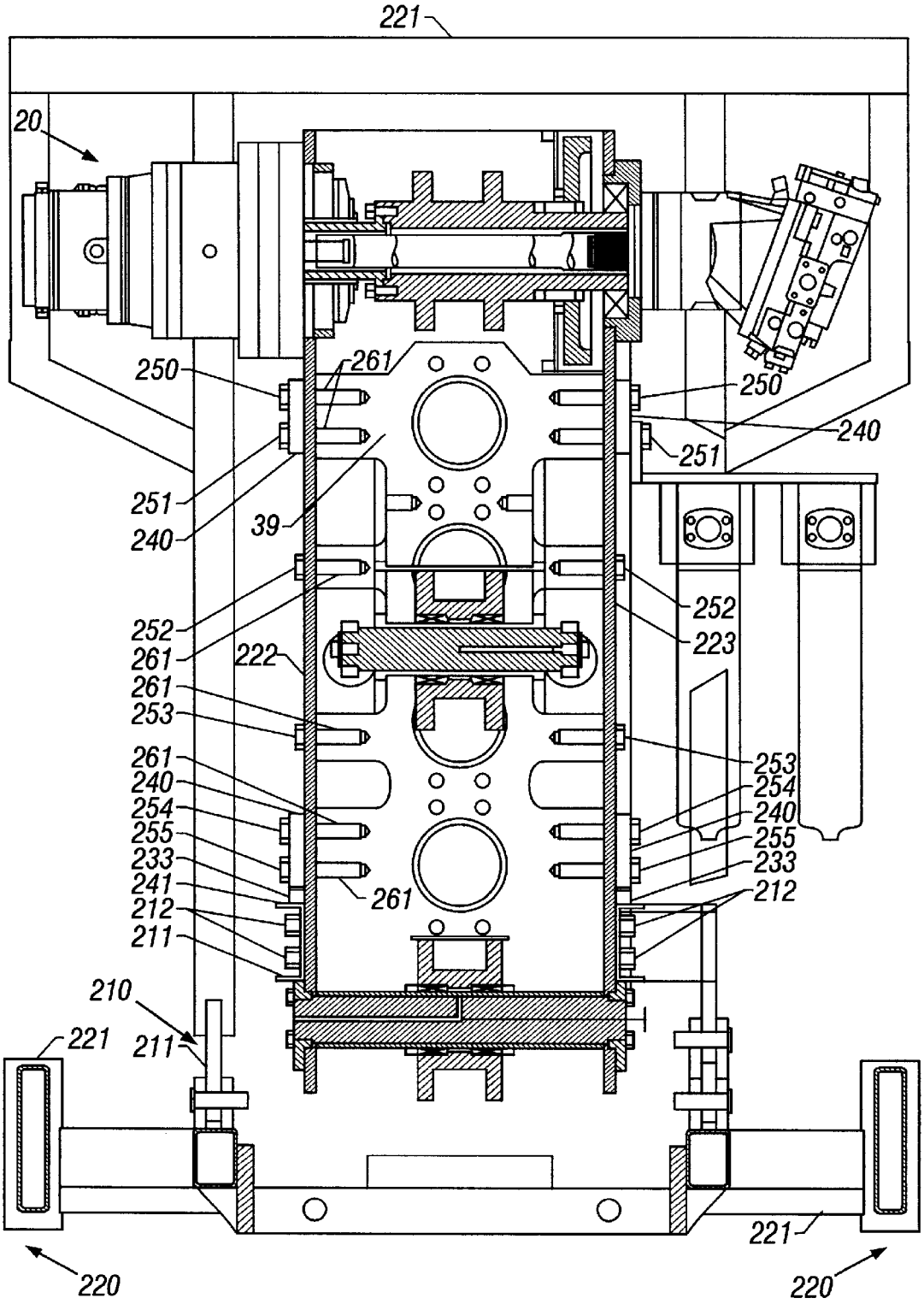
FIG. 7B is a partial cross-sectional side of the device shown in FIG. 7A.

The present invention is also directed to an injector head 20 that has adjustable halves 202, 204 for accommodating coiled tubing of different sizes. As shown in FIGS. 7A and 7B, the injector head 20 is comprised of the first half 202 and the second half 204 positioned on an inner frame 210 that is mounted within an outer frame 220. The outer frame 220 is comprised of a plurality of structural components 221. The inner frame 210 is comprised of a plurality structural components 211. As is known to those skilled in the art, the various structural components 221, 211 may be comprised of a variety of commonly used structural components, such as plates, I-beams, channel beams, structural tubing, etc., that are sized and configured in a manner sufficient to withstand all of the forces encountered in normal coiled tubing injection and retraction operations. The design, selection and sizing of these various components are matters of design choice that are well within the level of ordinary skill in the present art. Thus, these details should not be considered a limitation of the present invention.

The halves 202 and 204 of the injector head 20 of the present invention may be moved toward and away from one another in the direction indicated by the double arrow 206 in FIG. 7A. In the illustrative embodiment of the injector head 20 disclosed herein, each of the halves 202, 204 contain all of the major components constituting approximately one-half of the injector head 20. That is, in the illustrative embodiment of the injector head 20 disclosed herein, each half 202, 204 contains an endless chain 22, a plurality of gripper block assemblies 40, a drive sprocket 28, a plurality of idler sprockets 27, a tensioning cylinder 37, a plurality of traction cylinders 21, a bearing skate 34, and a drive motor (not shown). These components have not been numbered in FIGS. 7A and 7B for purposes of clarity. Each of the halves 202, 204 may be moved relative to one another, i.e., both halves 202, 204 may be movable, or only one of the halves 202, 204 may be designed to move relative to a fixed half 202, 204. All of the utilities used to support the various components of each half, e.g., electrical power, hydraulic fluid, pumps, etc., are either flexibly coupled to the movable halves or self-contained within each half.

In the illustrative embodiment disclosed herein, the first half 202 is comprised of a plurality of side plates 222, 223, and the second half 204 is comprised of a plurality of side plates 244, 245. Note that, FIG. 7B is a partial, cross-sectional view that primarily depicts the first half 202 and its various components. However, those skilled in the art will recognize that a description of the structure of the first half 202 and how it is secured in the inner frame 210 and outer frame 220 would apply equally as well to the second half 204.

The inner frame 210 is comprised of a plurality of structural members 211, and the first and second halves 202, 204 are coupled to the structural members 211 through a plurality of bolts 212 positioned within slots 214 formed in the structural members 211. In the disclosed embodiment, the bolts 212 are adapted for threaded engagement with a plurality of threaded holes (not shown) formed in the side plates 222, 223, 244 and 245. Of course, rather than having threaded holes formed in the side plates, the side plates 222, 223, 244 and 245 could be coupled to the structural member 211 via threaded bolts and nuts. However, access to the nuts during tightening and loosening operations may be more difficult. A plurality of guide rails 233 may be attached to the side plates 222, 223 and 244, 245 by use of a plurality of fasteners 235. The guide rails 233 are adapted to slidingly engage a top surface 241 of the structural member 211.

Figure 7C:
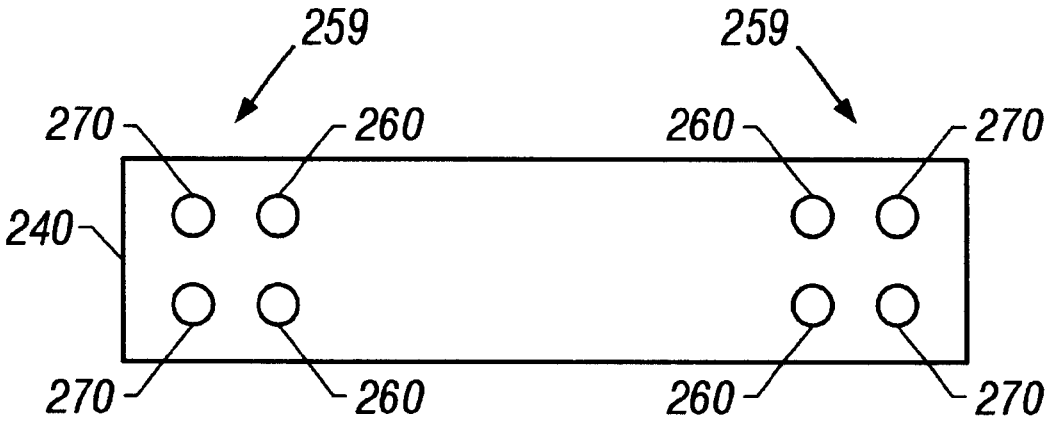
FIG. 7C is a side view of an illustration positioning bar that may be employed with the present invention.

A plurality of positioning bars 240 are positioned between the first and second halves 202, 204. A separate drawing of an illustrative positioning bar 240 that may be used with the present invention is shown in FIG. 7C. Although four positioning bars 240 are depicted in FIGS. 7A and 7B, depending upon the particular application, only two positioning bars 240 may be required. For example, a single one of the positioning bars 240 could be approximately centrally located on opposite sides of the halves 202, 204. Of course, more than two positioning bars 240 may be used on each side if desired. In one illustrative embodiment, the positioning bars 240 are approximately 1" thick, 5" wide, and 21" long. Other configurations are, of course, possible.

As shown in FIG. 7B, a plurality of bolts 250, 251, 252, 253, 254 and 255 are used to secure the side plates 222, 223 to the spline plate 39 via threaded nuts 261. Additionally, bolts 250, 251, 254 and 255 are used to secure the positioning bar 240 to the spline plate 39. In one illustrative embodiment, the spline plate 39 is approximately two inches thick and the bolts 250–255 are approximately 1" in diameter and approximately 3" long.

A plurality of openings 259 may be formed in the positioning bar 240. The openings 259 may take on a variety of shapes, such as circular openings or slots. In one illustrative embodiment of the present invention, the openings 259 are comprised of a plurality of holes 260, 270. As will be apparent to one skilled in the art upon a complete reading of the present application, when the bolts 250, 251, 254 and 255 are in the holes 260 (as shown in FIGS. 7A and 7C), the halves 202, 204 are in their closest position, and the injector head 20 is ready for use on smaller diameter coiled tubing, such as ½"–2" diameter coiled tubing. Although not shown in FIG. 7A, when the bolts 250, 251, 254 and 255 are in the holes 270 (as shown in FIGS. 7A and 7C), the halves 202, 204 are spaced apart their greatest distance and the injector head 20 is ready for use on larger diameter coiled tubing, such as 2⅜"–5" diameter coiled tubing.

The number of openings 259, such as holes 260, 270, may be varied as a matter of design choice and depending upon the desired degree of adjustability of the injector head 20. For example, if it is desired to have more adjustment settings, then more openings 259 may be added to the positioning bar 240. Moreover, it is not required that the positioning bar 240 have an equal number of openings 259 on each side of the bar 240. For example, where only one of the halves is designed to be moved, then one end of the positioning bar 240 may not have any additional openings 259. It is even envisioned that an arrangement could be made whereby one end of the positioning bar 240 is welded to one of the side plates, e.g., side plate 222, while the other end has a plurality of openings 259, e.g., holes 260, 270, formed therein. However, it is believed that the openings 259, such as holes 260, 270, should be positioned symmetrically on both ends of the positioning bar 240. In this manner, both halves 202, 204 of the injector head 20 may be moved approximately half the distance by which the halves 202, 204 are separated during the movement. In this manner, the centerline of the coiled tubing 46 remains in approximately the same location regardless of the size of the coiled tubing 46. In one illustrative embodiment, the holes positioning 260, 270 are laterally spaced apart by a distance of approximately 2".

To provide movement of the halves 202, 204 to accommodate larger sizes of coiled tubing, e.g., coiled tubing having a diameter ranging from approximately 2⅜"–5", the following process may be performed. First, bolts 250, 251, 254 and 255 are removed from the illustrative holes 260 (8 per half) and the bolts 212 are loosened (8 per half). Thereafter, a plurality of the traction cylinders 21 are actuated until the threaded holes 261 in the spline plate 39 are aligned with the holes 270 in the positioning bar 240. Thereafter, the bolts 250, 251, 254 and 255 are repositioned through the holes 270 in the positioning bar 240 and into engagement with the threaded holes 261 in the spline plate 39. The bolts 250, 251, 254, 255 and 212 are then tightened to secure the halves 202 and 204 of the injector head 20 in their open position (not shown). Once the halves 202, 204 are in their open position, new gripper blocks 54 may be installed to accommodate insertion and withdrawal of larger diameter coiled tubing 46.

The movement of the halves 202, 204 closer together, e.g., from their open position to their closed position, may be accomplished by a variety of techniques. First, the gripper blocks 54 may be changed to accommodate the smaller sized coiled tubing 46. Then, as described above, the bolts 250, 251, 254 and 255 would have to be removed and the bolts 212 loosened. Thereafter, the halves 202, 204 may be urged together by a variety of techniques. For example, the halves 202, 204 may be urged together through use of a plurality of come-along devices, the ends of which are hooked to the clips (not shown) on the halves 202, 204. The halves 202, 204 may also be manually urged together.

Figure 7D:
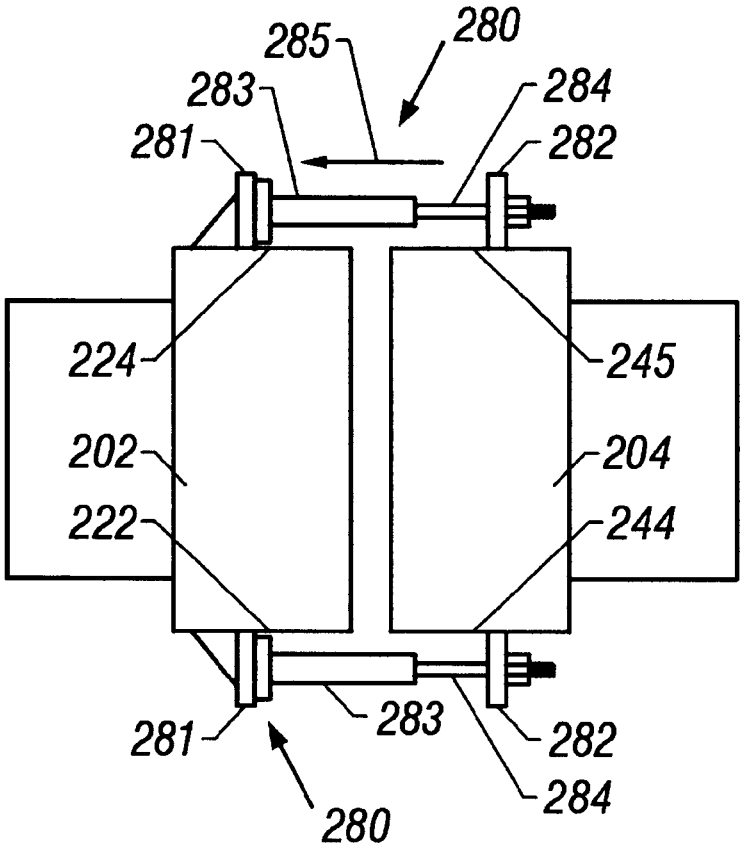
FIG. 7D is a depiction of an illustrative moving apparatus that may be used with the adjustable housing of the present invention.

Alternatively, as shown in FIG. 7D, a moving assembly 280 may be positioned between the halves 202, 204. The moving assembly 280 is comprised of a plurality of support lugs 281, 282 that are fixedly coupled to the side plates 222, 223, 244, 245 by, for example, welding. The moving assembly 280 further comprises a plurality of hydraulic cylinders 283, each with a rod 284. The hydraulic cylinders 282 and their rods 284 are releasably coupled to the support lugs 281, 282, respectively. In use, the hydraulic cylinders 283 are positioned between the support lugs 281, 282, and the hydraulic cylinders 283 are activated to exert a force in the direction indicated by arrows 284 to urge the halves 202, 204 together. The moving assembly 280 may be permanently attached to the injector head 20, or it may be completely removable and used only when adjusting the spacing between the halves 202, 204. Additionally, the moving assembly 280 could also be used to urge the two halves 202, 204 apart. Of course, the support lugs 281 and 282 need not take on any particular shape or form. In fact, it is envisioned that portions of each half 202, 204 can serve the functions of the support lugs 281 and 282. It is sufficient that hydraulic cylinders 283 be coupled to some portion of the halves 202, 204 of the injector head 20 in a manner that can absorb the forces induced when the hydraulic cylinders 283 are actuated.

The present invention is also directed to a variety of novel methods for injecting and withdrawing coiled tubing 46 into and from a well. In particular, the method comprises positioning a plurality of gripper block assemblies 40 around a plurality of middle links 58 of a plurality of endless chains 22, positioning the coiled tubing 46 into engagement with the plurality of gripper block assemblies 40, and actuating the endless chains 22 so as to insert or withdraw the coiled tubing 46 into or from a well. More particularly, the method comprises positioning at least two halves 50, 52 of a gripper block assembly 40 around a plurality of middle links 58 of a plurality of endless chains 22, and releasably coupling a gripper block 54 to one of the two halves 50, 52 positioned around the endless chains 22. The method continues with the positioning of the coiled tubing 46 into engagement with the gripper blocks 54, and actuating the endless chains 22 so as to insert or withdraw the coiled tubing 46 into or from a well.

Another method of the present invention is comprised of moving the halves 202, 204 of a coiled tubing injector head 20 from a first position, for use with smaller diameter coiled tubing, to a second position, for use with larger diameter coiled tubing, and thereafter inserting or withdrawing coiled tubing into or from a well. In particular, the method comprises removing a plurality of bolts that secure a positioning bar 240 between each half 202, 204 of the injector head 20 through a plurality of holes 260 in the positioning bar 240, repositioning at least one of the halves 202, 204 of the injector head 20 to a new position such that each half 202,

204 may be secured to the positioning bar 240 via a plurality of holes 270 in the positioning bar 240, the holes 260, 270 in the positioning bar 240 being laterally spaced apart from one another. Thereafter, the coiled tubing 46 is inserted into or withdrawn from a well with the halves 202, 204 in their new position. Of course, as disclosed herein, the repositioning of the halves 202, 204 may be performed to either spread the halves 202, 204 apart, or reposition the halves 202, 204 closer together.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A gripper block assembly, comprising:

a chain skate;

a gripper block holder, wherein said chain skate and said gripper block holder are adapted to be positioned on opposite sides of and around a link of an endless chain and releasably secured to one another to thereby secure said chain skate and said gripper block holder to said link; and a gripper block releasably coupled to said gripper block holder.

2. The gripper block assembly of claim 1, wherein said chain skate and said gripper block holder are bolted together.

3. The gripper block assembly of claim 1, wherein said gripper block holder has a dual-diameter, through-hole formed therein, and said chain skate has a threaded recess formed therein.

4. The gripper block assembly of claim 1, wherein said gripper block is slidingly, releasably coupled to said gripper block holder.

5. The gripper block assembly of claim 1, wherein said gripper block is releasably coupled to said gripper block holder by engaging grooves and projections.

6. The gripper block assembly of claim 1, wherein said chain skate and said gripper block holder are releasably secured together by a fastener, said gripper block having a bottom surface, said gripper block holder having a top surface, said top and bottom surfaces being spaced apart a distance sufficient to prevent disengagement of said fastener.

7. The gripper block assembly of claim 1, further comprising a means for releasably securing said gripper block to said gripper block holder.

8. The gripper block assembly of claim 7, wherein said means for releasably securing said gripper block to said gripper block holder comprises a cotter pin positionable through a plurality of brackets, at least one of said plurality of brackets being attached to said gripper block, the other of said plurality of brackets being attached to said gripper block holder.

9. The gripper block assembly of claim 1, wherein said chain skate comprises a flange, said flange having a surface adapted for engaging a plurality of bearings.

10. A gripper block assembly, comprising:

a chain skate comprised of a surface adapted for engaging a plurality of bearings;

a gripper block holder, wherein said chain skate and said gripper block holder are adapted to be positioned on opposite sides of and around a middle link of a triple-wide chain and releasably secured to one another to thereby secure said chain skate and said gripper block holder to said link; and a gripper block releasably coupled to said gripper block holder.

11. The gripper block assembly of claim 10, wherein said chain skate and said gripper block holder are bolted together.

12. The gripper block assembly of claim 10, wherein said gripper block assembly has a dual-diameter through-hole formed therein and said chain skate has a threaded recess formed therein.

13. The gripper block assembly of claim 10, wherein said gripper block is slidingly, releasably coupled to said gripper block holder.

14. The gripper block assembly of claim 10, wherein said gripper block is releasably coupled to said gripper block holder by engaging grooves and projections.

15. The gripper block assembly of claim 10, wherein said chain skate and said gripper block holder are releasably secured together by a fastener, said gripper block having a bottom surface, said gripper block holder having a top surface, said top and bottom surfaces being spaced apart a distance sufficient to prevent disengagement of said fastener.

16. The gripper block assembly of claim 10, further comprising a means for releasably securing said gripper block to said gripper block holder.

17. The gripper block assembly of claim 10, wherein said means for releasably securing said gripper block to said gripper block holder comprises a cotter pin positionable through a plurality of brackets, at least one of said plurality of brackets being attached to said gripper block, the other of said plurality of brackets being attached to said gripper block holder.

18. The gripper block assembly of claim 10, wherein said chain skate comprises a flange, said flange having a surface adapted for engaging a plurality of bearings.

19. A gripper block assembly, comprising:

a chain skate;

a gripper block holder, said chain skate and said gripper block holder adapted to be positioned around a link of an endless chain and releasably secured to one another, wherein said gripper block holder has a dual-diameter, through-hole formed therein, and said chain skate has a threaded recess formed therein;

a gripper block releasably coupled to said gripper block holder; and a bolt positioned in said dual-diameter, through-hole and into engagement with said threaded recess in said chain skate, said bolt having a head that has a surface that does not extend beyond a top surface of said gripper block holder.

20. A gripper block assembly, comprising:

a chain skate comprised of a surface adapted for engaging a plurality of bearings;

a gripper block holder, said chain skate and said gripper block holder adapted to be positioned around a middle link of a triple-wide chain and releasably secured to one another, wherein said gripper block assembly has a dual-diameter through-hole formed therein and said chain skate has a threaded recess formed therein;

a gripper block releasably coupled to said gripper block holder; and a bolt positioned in said dual-diameter through-hole and into engagement with said threaded recess in said chain skate, said bolt having a head that has a surface that does not extend beyond a top surface of said gripper block holder.

21. A gripper block assembly, comprising:

a chain skate;

a gripper block holder, wherein said chain skate and said gripper block holder are adapted to be positioned on opposite sides of and around a plurality of rollers of a link of an endless chain and releasably secured to one another to thereby secure said chain skate and said gripper block holder to said link; and a gripper block releasably coupled to said gripper block holder.

22. The gripper block assembly of claim 21, wherein said chain skate and said gripper block holder are bolted together.

23. The gripper block assembly of claim 21, wherein said gripper block is slidingly, releasably coupled to said gripper block holder.

24. The gripper block assembly of claim 21, wherein said gripper block is releasably coupled to said gripper block holder by engaging grooves and projections.

25. The gripper block assembly of claim 21, wherein said chain skate and said gripper block holder are releasably secured together by a fastener, said gripper block having a bottom surface, said gripper block holder having a top surface, said top and bottom surfaces being spaced apart a distance sufficient to prevent disengagement of said fastener.

26. The gripper block assembly of claim 21, further comprising a means for releasably securing said gripper block to said gripper block holder.

27. The gripper block assembly of claim 26, wherein said means for releasably securing said gripper block to said gripper block holder comprises a cotter pin positionable through a plurality of brackets, at least one of said plurality of brackets being attached to said gripper block, the other of said plurality of brackets being attached to said gripper block holder.

28. The gripper block assembly of claim 21, wherein said chain skate comprises a flange, said flange having a surface adapted for engaging a plurality of bearings.

29. A gripper block assembly, comprising:

a chain skate comprised of a surface adapted for engaging a plurality of bearings;

a gripper block holder, wherein said chain skate and said gripper block holder are adapted to be positioned on opposite sides of and around a plurality of rollers of a middle link of a triple-wide chain and releasably secured to one another to thereby secure said chain skate and said gripper block holder to said link; and a gripper block releasably coupled to said gripper block holder.

30. The gripper block assembly of claim 29, wherein said chain skate and said gripper block holder are bolted together.

31. The gripper block assembly of claim 29, wherein said gripper block is slidingly, releasably coupled to said gripper block holder.

32. The gripper block assembly of claim 29, wherein said gripper block is releasably coupled to said gripper block holder by engaging grooves and projections.

33. The gripper block assembly of claim 29, wherein said chain skate and said gripper block holder are releasably secured together by a fastener, said gripper block having a bottom surface, said gripper block holder having a top surface, said top and bottom surfaces being spaced apart a distance sufficient to prevent disengagement of said fastener.

34. The gripper block assembly of claim 29, further comprising a means for releasably securing said gripper block to said gripper block holder.

35. The gripper block assembly of claim 29, wherein said means for releasably securing said gripper block to said gripper block holder comprises a cotter pin positionable through a plurality of brackets, at least one of said plurality of brackets being attached to said gripper block, the other of said plurality of brackets being attached to said gripper block holder.

36. The gripper block assembly of claim 29, wherein said chain skate comprises a flange, said flange having a surface adapted for engaging a plurality of bearings.

37. A gripper block assembly, comprising:

a chain skate;

a gripper block holder, said chain skate and said gripper block holder adapted to be positioned around a link of an endless chain and releasably secured to one another, wherein said link is comprised of a plurality of rollers, each having a circumference, and wherein said chain skate and said gripper block holder are adapted to be positioned around said circumference of said rollers; and a gripper block releasably coupled to said gripper block holder.

38. The gripper block assembly of claim 37, wherein said chain skate and said gripper block holder are bolted together.

39. The gripper block assembly of claim 37, wherein said gripper block is slidingly, releasably coupled to said gripper block holder.

40. The gripper block assembly of claim 37, wherein said gripper block is releasably coupled to said gripper block holder by engaging grooves and projections.

41. The gripper block assembly of claim 37, wherein said chain skate and said gripper block holder are releasably secured together by a fastener, said gripper block having a bottom surface, said gripper block holder having a top surface, said top and bottom surfaces being spaced apart a distance sufficient to prevent disengagement of said fastener.

42. The gripper block assembly of claim 37, further comprising a means for releasably securing said gripper block to said gripper block holder.

43. The gripper block assembly of claim 42, wherein said means for releasably securing said gripper block to said gripper block holder comprises a cotter pin positionable through a plurality of brackets, at least one of said plurality of brackets being attached to said gripper block, the other of said plurality of brackets being attached to said gripper block holder.

44. The gripper block assembly of claim 37, wherein said chain skate comprises a flange, said flange having a surface adapted for engaging a plurality of bearings.

* * * * *

UNITED STATES PATENT AND TRADEMARK OFFICE

CERTIFICATE OF CORRECTION

PATENT NO. : 6,609,566 B2
DATED : August 26, 2003
INVENTOR(S) : Dudley Joseph Perio, Jr.

It is certified that error appears in the above-identified patent and that said Letters Patent is hereby corrected as shown below:

Column 14,
Line 29, "claim 10" should be -- claim 16 --.

Column 16,
Line 10, "claim 29" should be -- claim 34 --

Signed and Sealed this

Second Day of December, 2003

JAMES E. ROGAN
*Director of the United States Patent and Trademark Office*